US009475043B2

(12) United States Patent
Daub et al.

(10) Patent No.: US 9,475,043 B2
(45) Date of Patent: Oct. 25, 2016

(54) CARTRIDGE, CENTRIFUGE AND METHOD FOR MIXING A FIRST AND SECOND COMPONENT

(75) Inventors: Martina Daub, Weissach (DE); Juergen Steigert, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 890 days.

(21) Appl. No.: 13/490,882

(22) Filed: Jun. 7, 2012

(65) Prior Publication Data

US 2012/0314531 A1 Dec. 13, 2012

(30) Foreign Application Priority Data

Jun. 7, 2011 (DE) ..... 10 2011 077 134

(51) Int. Cl.

| | |
|---|---|
| ***B01L 3/00*** | (2006.01) |
| ***B01F 9/00*** | (2006.01) |
| ***B01F 11/04*** | (2006.01) |
| ***B01F 13/08*** | (2006.01) |
| ***B01F 15/02*** | (2006.01) |

(52) U.S. Cl.

CPC ..... *B01L 3/5021* (2013.01); *B01F 9/002* (2013.01); *B01F 9/0003* (2013.01); *B01F 11/04* (2013.01); *B01F 13/0854* (2013.01); *B01F 15/0212* (2013.01); *B01F 15/0223* (2013.01); *B01F 15/0233* (2013.01); *B01L 2200/16* (2013.01); *B01L 2300/0672* (2013.01); *B01L 2300/0841* (2013.01); *B01L 2400/043* (2013.01); *B01L 2400/0409* (2013.01)

(58) Field of Classification Search

CPC ..... B01L 3/5021

USPC ..... 366/273–275; 422/72; 494/45, 47

See application file for complete search history.

(56) References Cited

U.S. PATENT DOCUMENTS

| | | | | |
|---|---|---|---|---|
| 2,184,152 | A * | 12/1939 | Saffir | B65D 81/3277 206/222 |
| 2,854,143 | A * | 9/1958 | Novak | 210/335 |
| 3,300,051 | A * | 1/1967 | Mitchell | 210/339 |
| 3,356,346 | A * | 12/1967 | Landsberger | 366/274 |
| 3,583,627 | A * | 6/1971 | Wilson | 494/36 |
| 5,073,341 | A * | 12/1991 | Hargreaves | 422/401 |

(Continued)

FOREIGN PATENT DOCUMENTS

| | | |
|---|---|---|
| CN | 1400060 A | 3/2003 |
| CN | 1723090 A | 1/2006 |

(Continued)

OTHER PUBLICATIONS

Grumann, M. et al., "Batch-mode mixing on centrifugal microfluidic platforms," The Royal Society of Chemistry, 2005, 5, pp. 560-565.

(Continued)

*Primary Examiner* — David Sorkin
*Assistant Examiner* — Abbas Rashid
(74) *Attorney, Agent, or Firm* — Maginot, Moore & Beck LLP

(57) ABSTRACT

A cartridge is configured for insertion and centrifugation in a centrifuge. The cartridge includes a mixing chamber, which comprises a container that is configured for at least one first component and at least one second component and electromagnetic particles. The electromagnetic particles are movable by an electromagnetic force to mix the first and second components.

13 Claims, 11 Drawing Sheets

(56) References Cited

U.S. PATENT DOCUMENTS

| | | | | |
|---|---|---|---|---|
| 5,186,827 | A * | 2/1993 | Liberti et al. | 210/222 |
| 5,466,574 | A * | 11/1995 | Liberti et al. | 435/5 |
| 5,552,064 | A * | 9/1996 | Chachowski et al. | 210/787 |
| 5,601,711 | A * | 2/1997 | Sklar et al. | 210/238 |
| 6,150,182 | A | 11/2000 | Cassaday | |
| 6,537,503 | B1 * | 3/2003 | Conway | 422/533 |
| 6,939,032 | B2 * | 9/2005 | Cosby | B01F 11/0045 366/114 |
| 2007/0251885 | A1 * | 11/2007 | Korpela et al. | 210/690 |
| 2009/0023610 | A1 | 1/2009 | Peytavi | |
| 2009/0269854 | A1 | 10/2009 | Kageyama | |
| 2011/0097816 | A1 * | 4/2011 | Goodwin | 436/178 |

FOREIGN PATENT DOCUMENTS

| | | | |
|---|---|---|---|
| CN | 201524452 | U | 7/2010 |
| EP | 2 329 877 | A1 | 6/2011 |
| EP | 2 388 067 | A1 | 11/2011 |
| EP | 2 514 515 | A1 | 10/2012 |
| EP | 2 532 426 | A2 | 12/2012 |
| EP | 2 532 427 | A2 | 12/2012 |
| EP | 2 535 108 | A1 | 12/2012 |
| JP | 2007-212263 | A | 8/2007 |
| WO | 2007/066783 | A1 | 6/2007 |

OTHER PUBLICATIONS

Grumann, M., Readout of Diagnostic Assays on a Centrifugal Microfluidic Platform, Dissertation zur Erlangung des Doktorgrades der Fakultat fur Angewandte Wissenschaften der Albert-Ludwigs Universitat Freiburg im Breisgau, Oct. 2005, pp. 73-86, Freiburg im Breisgau.

* cited by examiner

CARTRIDGE, CENTRIFUGE AND METHOD FOR MIXING A FIRST AND SECOND COMPONENT

This application claims priority under 35 U.S.C. §119 to patent application no. DE 10 2011 077 134.4, filed on Jun. 7, 2011 in Germany, the disclosure of which is incorporated herein by reference in its entirety.

BACKGROUND

Many biochemical processes are carried out on the basis of mixing different liquids. The liquids are generally mixed in a mixing chamber.

For example, document WO 2007066783 describes a microchip which comprises a mixing chamber. The mixing chamber contains particles which are moved under the effect of a centrifugal force.

The publication "Batch-mode mixing on centrifugal microfluidic platforms", Grumann et al., The Royal Society of Chemistry, 2005, describes a plate having a plurality of mixing chambers. The mixing chambers are filled with magnetic particles. The magnetic particles are moved to and fro by means of permanent magnets, which are arranged along a circular path, so as to mix liquids in the mixing chambers whilst the plate rotates.

SUMMARY

Compared to conventional solutions, the cartridge, the centrifuge, and the method have the advantage that the cartridge containing the first and second components is inserted into the centrifuge and, hereafter, the components can be mixed easily under the effect of the electromagnetic force. This can occur at a constant or varying rotational speed, that is to say the mixing operation can be carried out independently of the rotational speed and the associated effective centrifugal force.

Advantageous embodiments of the disclosure will emerge from the dependent claims.

In the present case, "component" means a liquid, a gas, or a particle. "First and second component" can also be understood to mean merely two different states of the same substance: For example, the first component may be formed as a clumped fraction, and the second component may be formed as a liquid fraction of the same substance.

In the present case, "electromagnetic force" means the force acting on an electrically charged material in an electric field, or on a magnet, in particular a permanent magnet, or a live conductor, in particular a coil, in a magnetic field.

The "means for producing the electromagnetic force" can be formed as a permanent magnet, coil or capacitor. The corresponding magnetic fields typically have a field strength of 10 to 300 mT.

In the present case, "electromagnetic particles" are understood to be particles which contain an electrically charged material or a magnetic or magnetizable material, for example iron or nickel.

According to one embodiment, the cartridge further has: a first drum, which has a first chamber, a displacement device, which is designed to rotate the first drum about the center axis thereof when the centrifugal force exceeds a predetermined threshold value so as to thus conductively connect the first chamber to a second chamber, the first and/or second chamber being formed as the mixing chamber. With appropriate selection of the rotational speed of a rotor of a centrifuge containing the cartridge, the first and/or second component can therefore advantageously be transferred between the first and second chamber. Depending on whether the first and/or second chamber is/are formed as a mixing chamber, the corresponding components can be mixed effectively in the first and/or second chamber. In the present case, "conductive(ly)" means so as to conduct liquid, gas and/or particles.

According to a further embodiment of the cartridge according to the disclosure, the displacement device comprises a first slanted edge, which cooperates with a second slanted edge of the first drum so as to bring the drum out of a first position, in which it engages with a positive fit with a housing of the cartridge in the direction of rotation about the center axis, and into a second position along the center axis, against the action of a restoring means, the positive fit being annulled in said second position and the first drum rotating about the center axis. A simple mechanism is thus provided so as to displace the first drum between at least two defined positions in the direction of rotation about the center axis.

According to a further embodiment of the cartridge according to the disclosure, the second chamber and/or a third chamber is/are arranged upstream or downstream of the first drum, based on the center axis, the first chamber preferably being connectable selectively and conductively to the second chamber or to the third chamber by means of the adjustment device. The mixing chamber can thus be arranged upstream and/or downstream of the first drum, or can be provided in the first drum itself. In addition, the mixing chamber can preferably be connected selectively to different further chambers as required.

According to a further embodiment of the cartridge according to the disclosure, a second drum, which has the second chamber, and/or a third drum, which has the third chamber, is/are provided. However, the second drum may just as equally also have the second chamber and the third chamber for example. The same applies to the third drum. Since a plurality of drums, in particular with a plurality of chambers which are displaced relative to one another, are provided, a wide range of different processes can be carried out automatically by means of the cartridge.

According to a further embodiment of the cartridge according to the disclosure, said cartridge further comprises a means for producing the electromagnetic force. Since the means is an element of the cartridge, the means can be adapted to a respective cartridge type and connected securely to the corresponding cartridge. For example, the means can be formed as a coil or as a permanent magnet.

According to a further embodiment of the cartridge according to the disclosure, the means is integrated into a housing of the cartridge, into the first, second and/or third drum. The means can thus be arranged easily in the region of the mixing chamber.

According to a further embodiment of the cartridge according to the disclosure, the mixing chamber comprises a flexible membrane, which divides the container into a first and a second volume, the at least one first and second components being receivable in the first volume and the electromagnetic particles being receivable in the second volume, the membrane being deformable by means of the electromagnetic particles under the effect of the electromagnetic force so as to mix the at least one first and second components. The particles are thus separated from the first and second components at all times, and therefore the particles can also be formed of non-sterile materials for example.

According to a further embodiment, the cartridge according to the disclosure further comprises the first and second components as well as the electromagnetic particles, the first component being formed as a biochemical probe and the second component being formed as a receptor molecule which binds the biochemical probe, the electromagnetic particles carrying the first or second component. The receptor molecules thus bind to the biochemical probes within a minimal period of time.

According to a further embodiment of the centrifuge according to the disclosure, the at least one means is designed to produce an electromagnetic force which acts against the centrifugal force, perpendicular to the centrifugal force and/or in the same direction as the centrifugal force. Different mixing effects can thus be achieved.

According to a further embodiment of the centrifuge according to the disclosure, at least one first and at least one second means are provided, the first means being arranged on one side of a circular path along which the cartridge is movable during centrifugation, and the second means being arranged on the other side of said circular path, and the first and second means being distanced from one another along the circular path. The particles can thus easily move to and fro in a direction perpendicular to the plane of the circular path.

According to a further embodiment of the centrifuge according to the disclosure, the at least one means is integrated into a housing of the centrifuge, in particular into a base and/or cover thereof. A simple design is thus produced.

According to an embodiment of the method according to the disclosure, the electromagnetic force changes whilst the cartridge is centrifuged. The electromagnetic force can change in terms of its amount and/or its direction.

BRIEF DESCRIPTION OF THE DRAWINGS

Exemplary embodiments of the disclosure are illustrated in the figures of the drawing and will be explained in greater detail in the following description.

In the figures.

DETAILED DESCRIPTION

In the figures, like or functionally like elements are denoted by like reference signs, unless stated otherwise.

Figure 1:
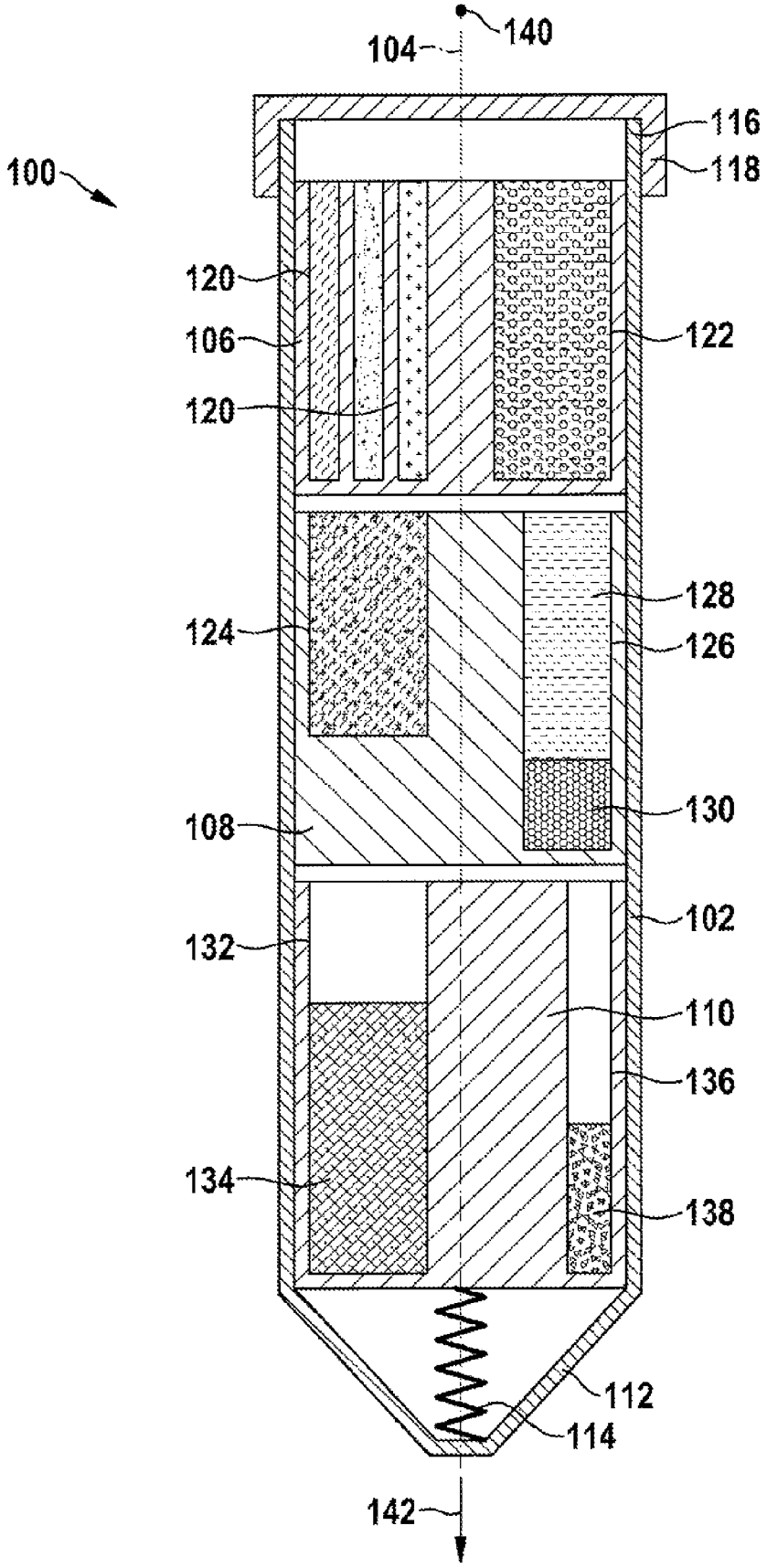
FIG. 1 shows a schematic sectional view through a cartridge in accordance with an exemplary embodiment of the present disclosure.

FIG. 1 shows a sectional view of a cartridge 100 in accordance with an exemplary embodiment of the present disclosure.

The cartridge 100 comprises a housing 102 in the form of a tube. For example, the housing 102 may be formed as a 15 mL centrifuge tube, 1.5 mL or 2 mL Eppendorf tube, or alternatively as a micro titer plate (for example 20 μl per well). The longitudinal axis of the housing 102 is denoted by 104.

For example, a first drum 108, a second drum 106 and a third drum 110 are received in the housing 102. The drums 106, 108, 110 are arranged in succession and with their respective center axes coaxially with the longitudinal axis 104.

The housing 102 is closed at one end 112. A restoring means, for example in the form of a spring 114, is arranged between the closed end 112 and the third drum 110 arranged adjacent thereto. The spring 114 can be formed as a spiral spring or as a polymer, in particular an elastomer. The other end 116 of the housing 102 is sealed by means of a seal 118. The seal 118 can preferably be removed so as to remove the drums 106, 108, 110 from the housing 102.

According to a further exemplary embodiment, the spring 114 is arranged between the seal 118 and the drum 106, and therefore the spring 114 is extended to produce a restoring force. Other arrangements of the spring 114 are also conceivable.

A respective drum 106, 108, 110 can have one or more chambers:

For example, the second drum 106 thus comprises a plurality of chambers 120 for reagents and a further chamber 122 for receiving a sample, for example a blood sample, which has been taken from a patient.

The first drum 108, which is arranged downstream of the second drum 106, comprises a mixing chamber 124, in which the reagents from the chambers 120 are mixed with the sample from the chamber 122. In addition, the first drum 108 comprises a further chamber 126 for example, in which the mixture from the mixing chamber 124 is separated into a liquid and a solid phase 128 and 130 respectively.

The third drum 110, again arranged downstream of the first drum 108, comprises a chamber 132 for receiving a waste product 134 from the chamber 126. Furthermore, the third drum 110 comprises a further chamber 136 for receiving the desired end product 138.

The cartridge 100 has an external geometry such that it can be inserted into a seat in a rotor of a centrifuge, in particular into a seat in a swing-out rotor or fixed-angle rotor of a centrifuge. During the centrifugation process, the cartridge 100 is rotated at high speed about a center of rotation 140 indicated schematically in FIG. 1. The center of rotation 140 lies on the longitudinal axis 104, and therefore a corresponding centrifugal force 142 acts along the longitudinal axis 104 on each element of the cartridge 100.

The objective is to control different processes within the cartridge 100 by means of suitable control of the rotational speed. For example, the mixing chamber 124 is first to be connected fluidically to the chamber 122 so as to receive the sample from the chamber 122. Hereafter, the mixing chamber 124 is to be connected to the chambers 120 so as to receive the reagents therefrom. The reagents and the sample are then to be mixed in the mixing chamber 124. The processes in the chambers 126, 132 and 136 are also to be controlled in a similar manner.

FIGS. 2A to 2G show perspective views of different parts of the cartridge 100 from FIG. 1. In particular, a displacement device 300 (see FIG. 3A), which makes it possible to control the above-mentioned processes in a manner partly dependent on rotational speed, will be explained hereinafter with reference to FIGS. 2A to 2G.

Figure 2A:
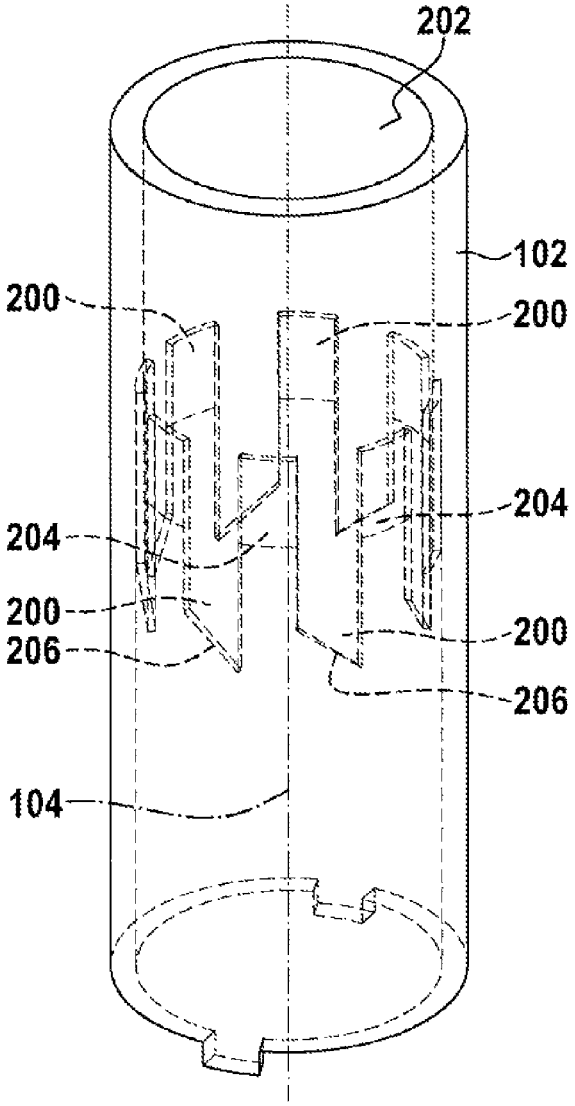
FIGS. 2A to 2G show perspective views of different parts of the cartridge from FIG. 1.

As shown in FIG. 2A, the housing 102 has protrusions 200 on its inner face. The protrusions 200 protrude radially towards the longitudinal axis 104 from the inner wall 202 of the housing. The protrusions 200 form slits 204 therebetween, which extend along the longitudinal axis 104. The protrusions 200 are each formed with a slanted edge 206 at one end. The slanted edges 206 point away from the center of rotation 140 during operation of the centrifuge with the cartridge 100.

Figure 2B:
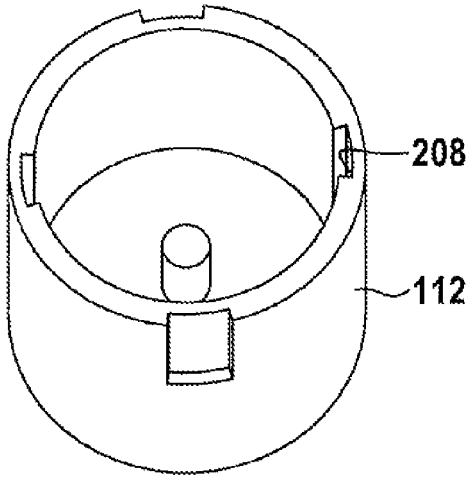

FIG. 2B shows the end 112 of the housing 102, said end, according to this exemplary embodiment, being formed as a removable cap. The end 112 has a plurality of grooves 208 in its inner circumference, said grooves extending along the longitudinal axis 104.

Figure 2C:
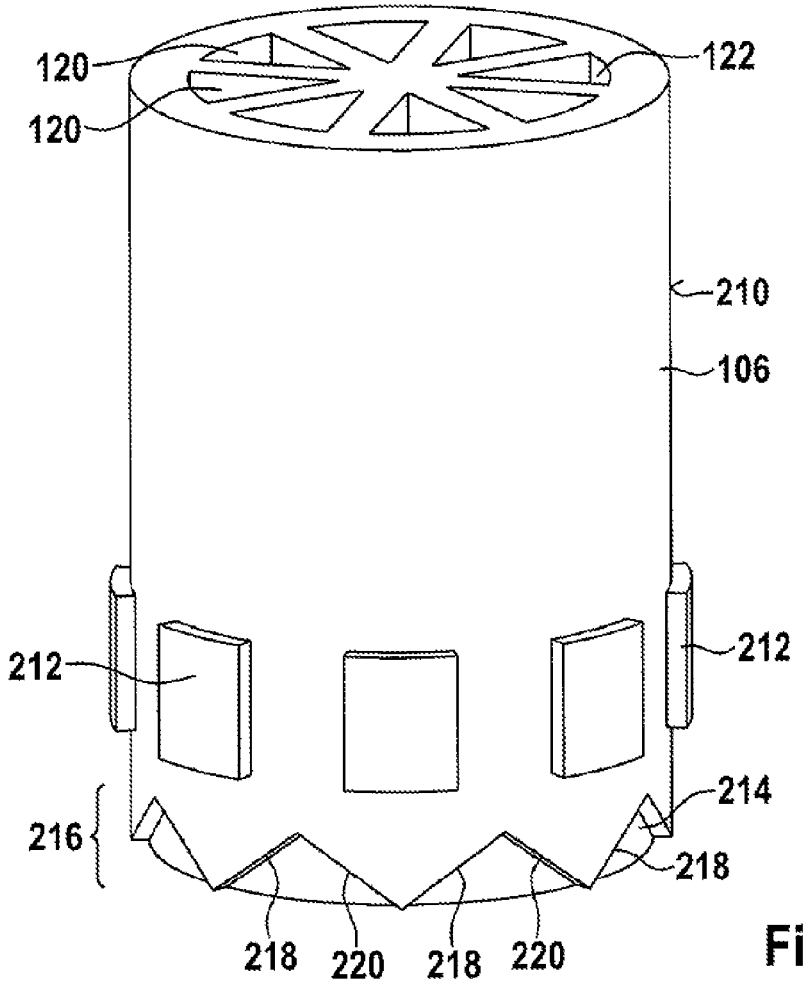

FIG. 2C shows the second drum 106 with the chambers 120, 122. The drum 106 has a plurality of protrusions 212 on its outer wall 210, said protrusions extending radially outwardly from the outer wall 210. When the cartridge 100 is assembled, the protrusions 212 of the drum 106 engage in the slits 204 in the housing 102. The drum 106 is thus blocked against rotation about the longitudinal axis 104. However, the drum 106 is displaceable along the longitudinal axis 104 in the slits 204. The second drum 106 further has a crown-like contour 216 on its outer wall 210, in particular at its end 214 facing the first drum 108, said contour comprising a multiplicity of slanted edges 218, 220. Every two slanted edges 218, 220 form an indent of the crown-like contour 216. The slanted edges 218, 220 likewise point away from the center of rotation 140 during operation of the centrifuge with the cartridge 100.

Figure 2D:
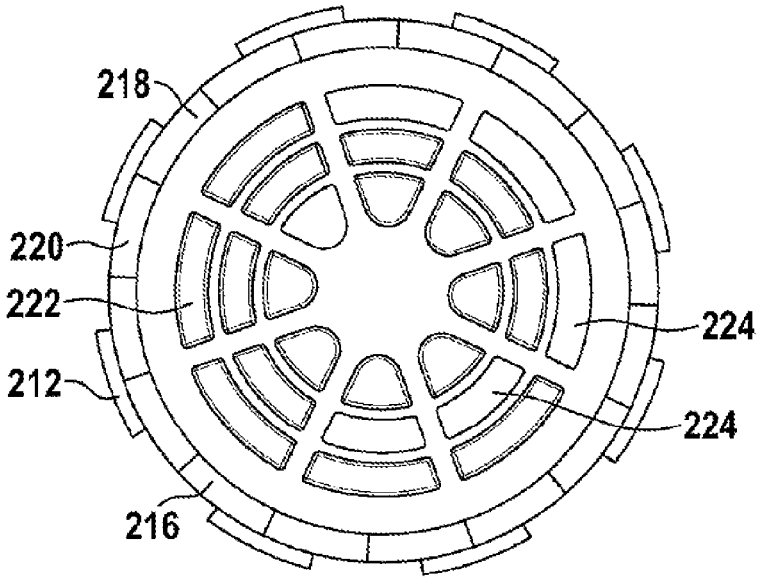

FIG. 2D shows the second drum 106 from FIG. 2C from below. The underside 222 of the drum 106 associated with the end 214 has a plurality of openings 224 so as to connect the chambers 120, 122 to the mixing chamber 124 of the first drum 108 so as to conduct liquid, gas and/or particles ("conductively" hereinafter). Alternatively or in addition, the openings 224 can also conductively connect the chambers 120, 122 to the chamber 126 of the first drum 108. A respective conductive connection is determined by the position of a respective opening 224 in relation to the chambers 124, 126. This position is achieved by rotating the first drum 108 relative to the second drum 106, as will be explained in greater detail hereinafter.

Figure 2E:
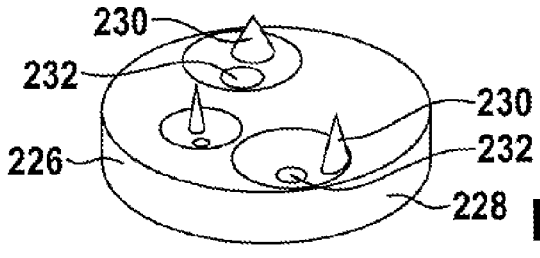

FIG. 2E shows a lancet device 226, which is not illustrated in FIG. 1. The lancet device 226 comprises a plate 228 having one or more mandrels 230 which are each arranged beside an opening 232 in the plate 228. The mandrels 230 are used, at controlled rotational speed, to pierce a respective opening 224 in the underside 222 of the second drum 106, whereupon in particular liquid from the corresponding chamber 120, 122 flows through the opening 232 and into the chambers 124 or 126.

Figure 2F:
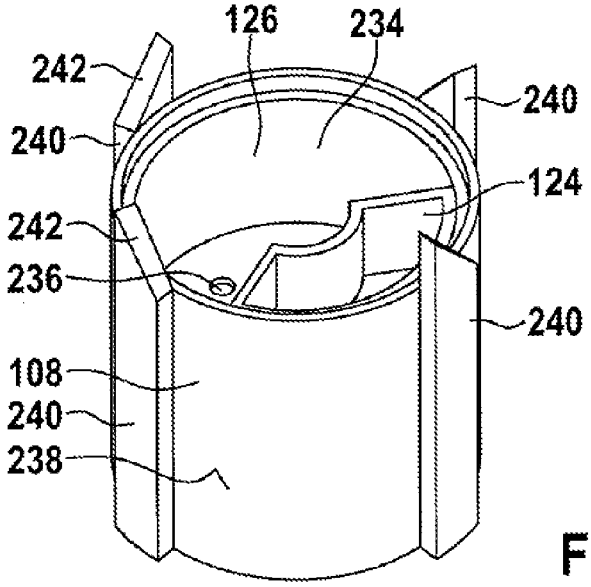

FIG. 2F shows the first drum 108 with the chambers 124, 126. For example, an opening 236 for conductive connection of the chamber 126 to the chambers 132, 136 of the third drum 110 is provided in the base 234 of the chamber 126. The first drum 108 has a plurality of protrusions 240 on its outer wall 238. The protrusions 240 are designed to engage in the slits 204 (just like the protrusions 212 of the second drum 106). Provided the protrusions 240 are engaged with the slits 240, rotation of the first drum 108 about the longitudinal axis 104 is blocked. However, the protrusions 204 and the drum 108 are movable in the slits 204 along the longitudinal axis 104. The protrusions 240 have slanted edges 242, which point towards the center of rotation 140 during operation of the centrifuge with the cartridge 100 and which are formed so as to correspond to the slanted edges 206 and 220.

Figure 2G:
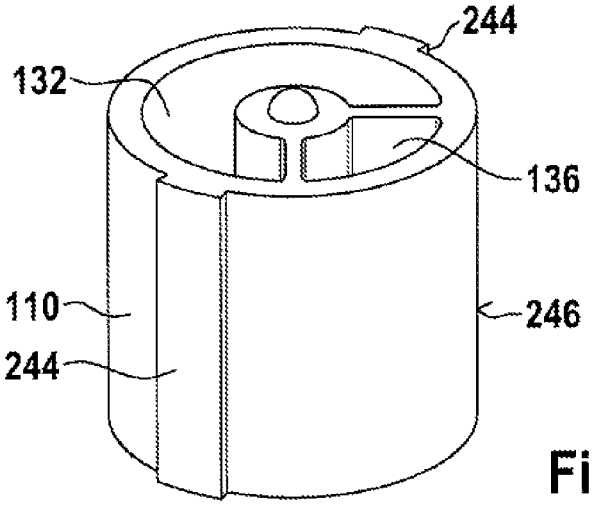

FIG. 2G shows the third drum 110 with the chambers 132, 136. The drum 110 has protrusions 244, which each protrude from the outer wall 246 of the drum 110. The protrusions 244 are designed to engage in the grooves 208 in the end 112 so that the drum 110 is displaceable in the grooves 208 in the longitudinal direction 104. Rotation of the drum 110 about the longitudinal axis 104 is thus blocked, however.

Figure 3A:
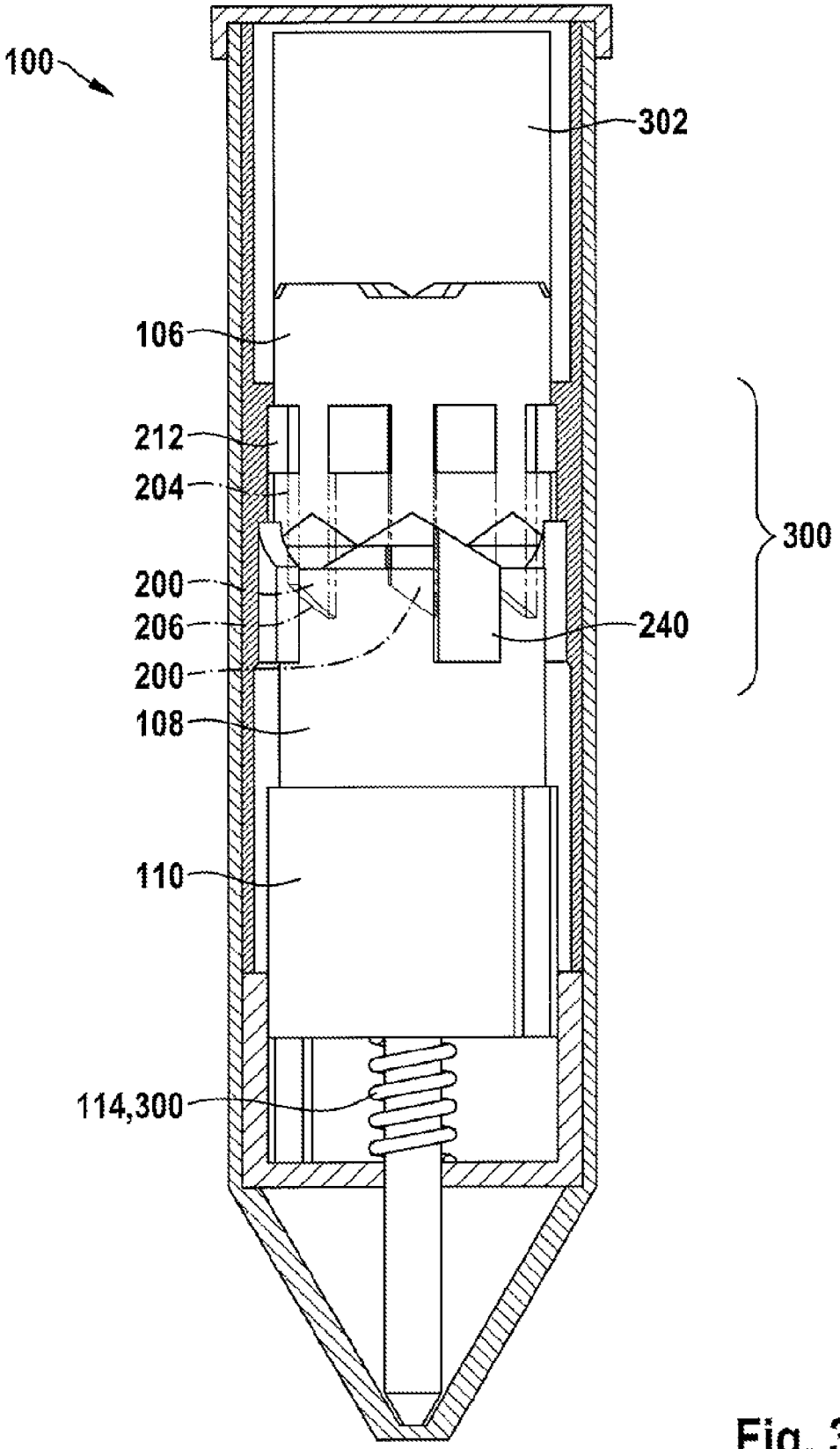
FIGS. 3A to 3E show different operating states of the cartridge from FIG. 1.
Figure 3B:
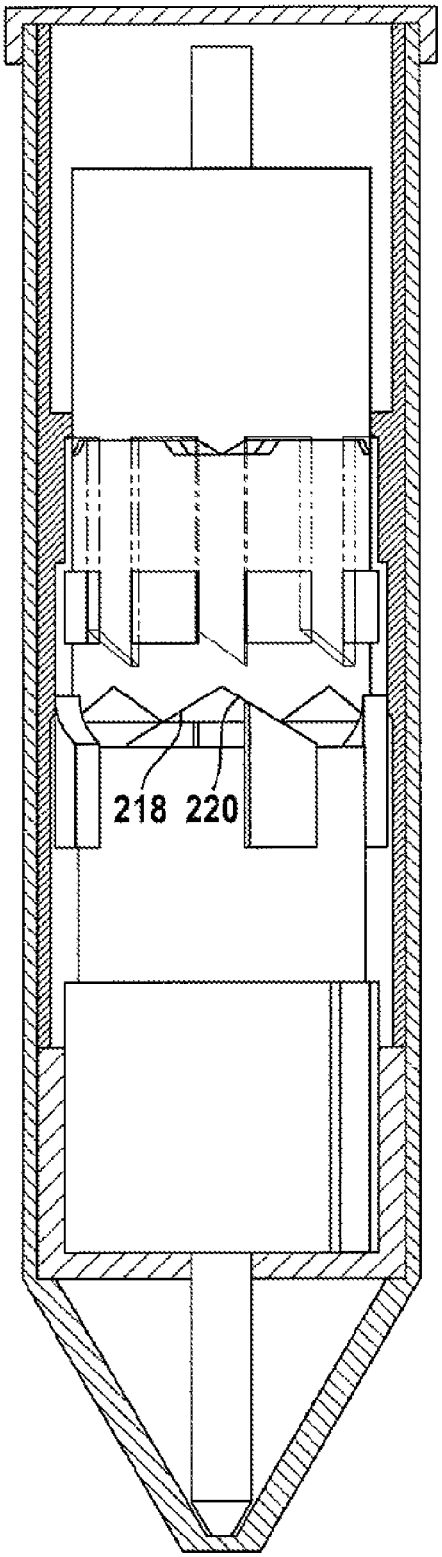
Figure 3C:
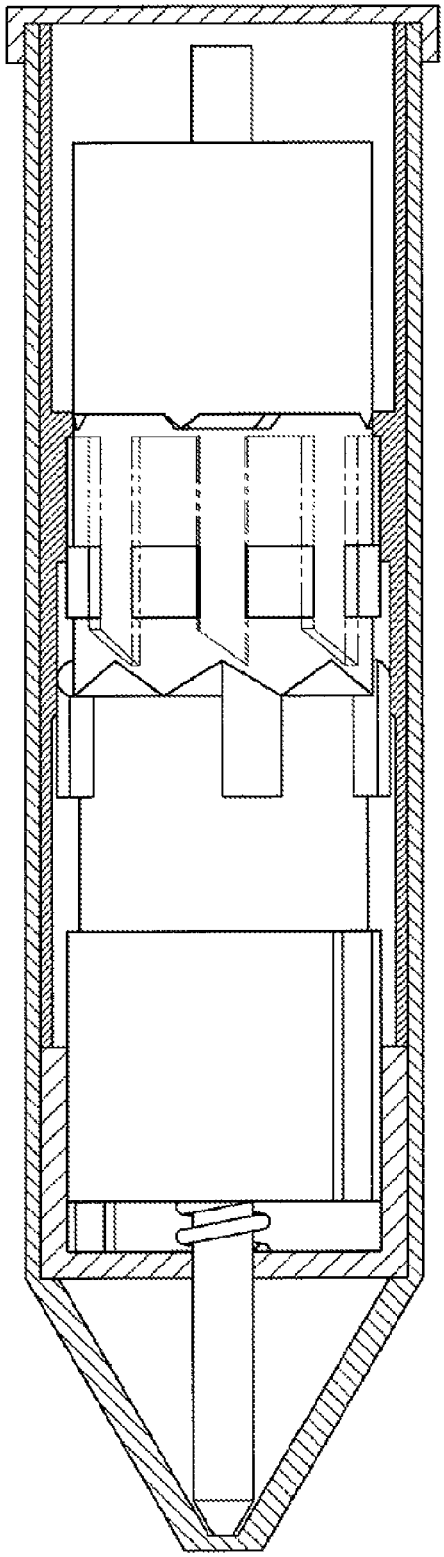
Figure 3D:
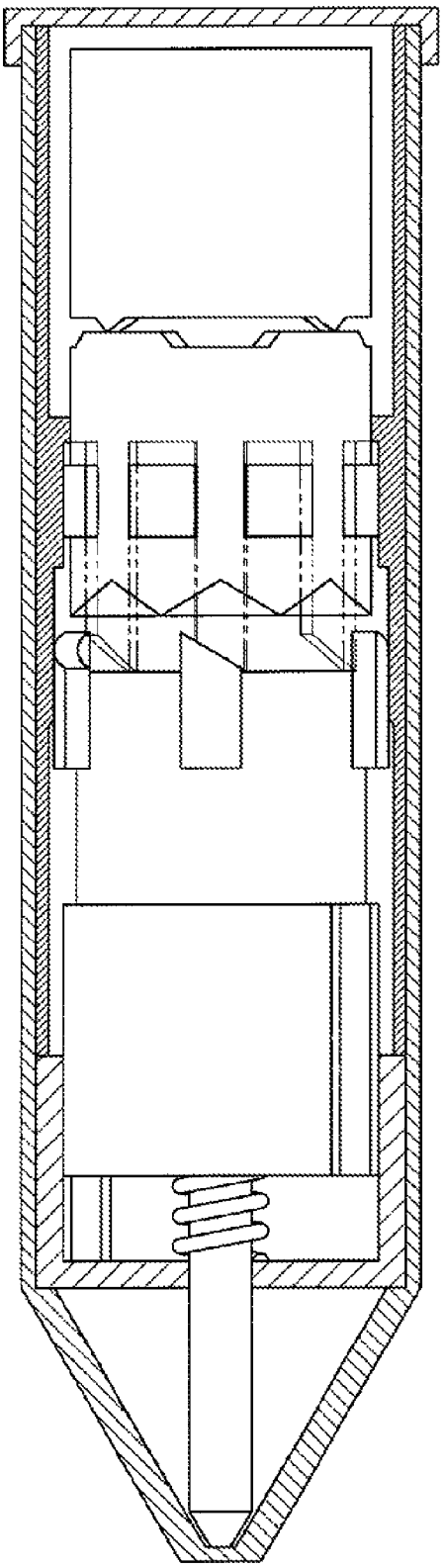
Figure 3E:
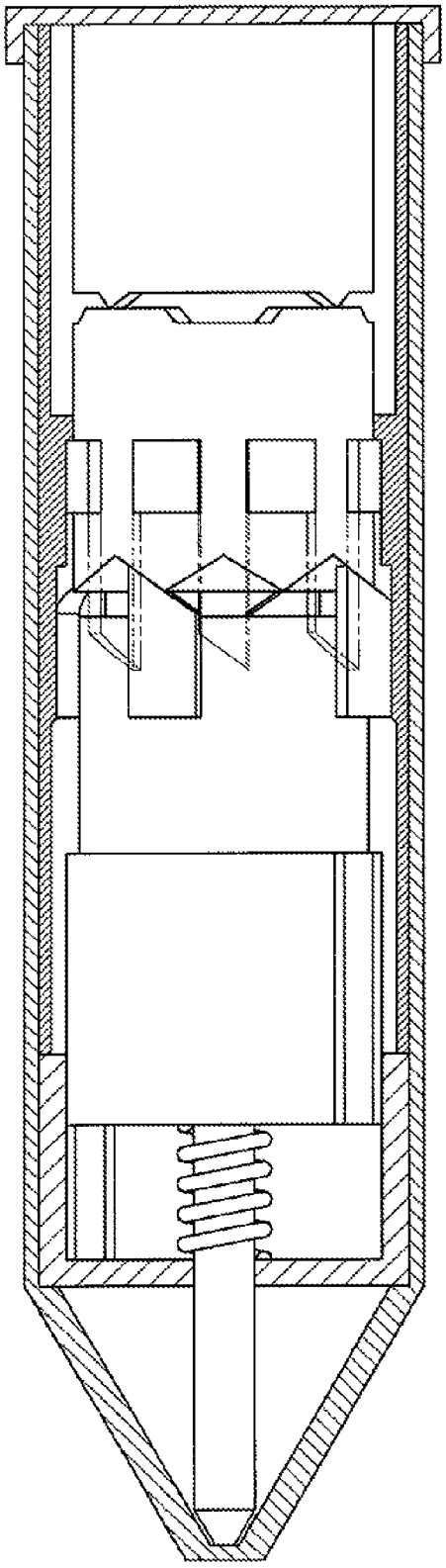

FIGS. 3A to 3E show a number of operating states during operation of the cartridge 100 from FIG. 1, wherein an additional drum 302 is illustrated, which is of no further relevance in the present case however. FIGS. 4A to 4E correspond to FIGS. 3A to 3E respectively and illustrate the movement of the slanted edges 206, 218, 220, 242 relative to one another. However, it should also be noted that FIG. 3B shows a more advanced operating state of the cartridge 100 compared to the state shown in FIG. 4B. In FIGS. 3A to 3E, the housing 102 is illustrated transparently in part so as to show the interior.

The protrusions 200, the slits 204, the slanted edges 206, the protrusions 212, the slanted edges 218, 220, the protrusions 240 and the slanted edges 242 form the above-mentioned displacement device 300, together with the restoring spring 114, for defined rotation of the first drum 108 relative to the further drums 106, 110 about the longitudinal axis 104.

Figures 4A, 4B, 4C, 4D, 4E:
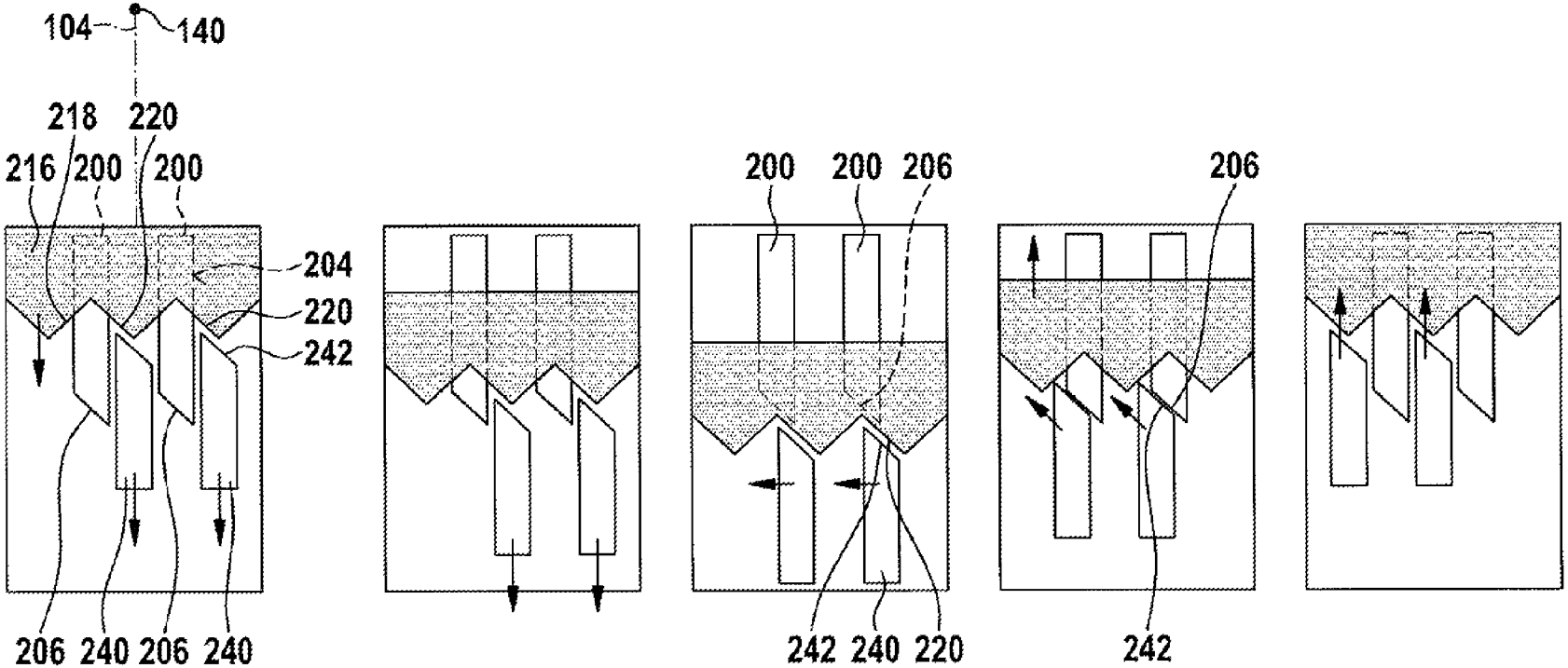
FIGS. 4A to 4E show detailed views of a displacement device in accordance with the different operating states from FIGS. 3A to 3E.

FIGS. 3A and 4A show a first position, in which the protrusions 240 of the first drum 108 engage in the slits 204, thus blocking rotation of the drum 108 about the longitudinal axis 104. If the rotational speed of the centrifuge is increased, the second drum 106 thus presses against the slanted edges 242 of the first drum 108 by means of the slanted edges 220 of the contour 216, against the action of the spring 114, thus compressing the spring 114. The first drum 108 thus moves away from the center of rotation 140, as indicated by the corresponding arrows in FIGS. 4A and 4B. This movement is continued until the protrusions 240 become disengaged from the protrusions 200. In this second position, rotation of the first drum 108 about the longitudinal axis 104 is released, as illustrated in FIG. 4C. Due to the cooperation between the slanted edges 220 and 242, which for example are each oriented at an angle of 45° to the longitudinal axis 104, a force component is produced, which automatically rotates the first drum 108 when said drum reaches the second position, as indicated by arrows directed to the left in FIG. 4C.

If the rotational speed is then reduced again, which involves a corresponding reduction in centrifugal force, the spring 114 thus presses the first drum 108 by means of the third drum 110 back towards the center of rotation 140. The second drum 106, together with its slanted edges 220, is thus likewise moved back towards the center of rotation 140, whereby the slanted edges 242 of the first drum 108 come to lie against the slanted edges 206 of the housing 102 and slide along these slanted edges, thus implementing a further rotational movement of the first drum 108 into a third position, as illustrated in FIGS. 4D and 4E. In the third position, the protrusions 240 of the first drum 108 are again arranged in the slits 204 in the housing 102 so that further rotation of the first drum 108 about the longitudinal axis 104 is blocked again.

The above-described process can be repeated as often as desired, so as to rotate the first drum 108 in a defined manner relative to the other drums 106 and 110.

Figure 5:
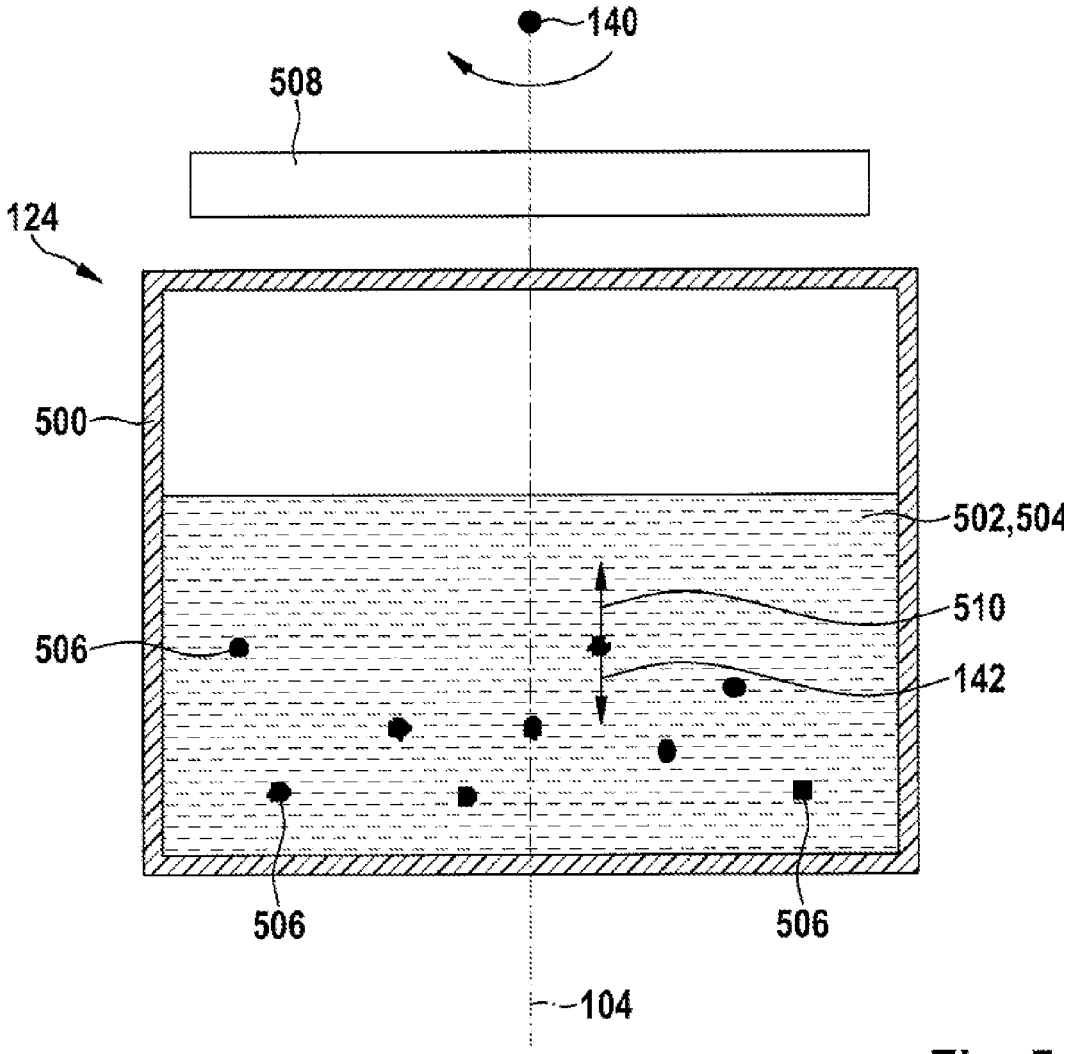
FIG. 5 shows a sectional view of the mixing chamber from FIG. 1, including further elements.

FIG. 5 shows a sectional view of the mixing chamber 124 from FIG. 1 in accordance with an exemplary embodiment of the present disclosure. However, it would also be equally possible to form one of the chambers 120, 122 of the second drum 106 or to form one of the chambers 132, 136 of the third drum 110, which are arranged upstream or downstream of the first drum 108, in accordance with the mixing chamber 124.

The mixing chamber 124 comprises a container 500 for receiving at least two components 502, 504. Such components are preferably components which are provided by means of the second drum 106, for example by means of one or more of the chambers 120, 122. For example, the components 502, 504 can be formed as reagents or samples, in particular blood samples. FIG. 5 shows the container 500, containing a mixture of two liquids 502, 504. The liquids 502, 504 can be of the same or different density. The liquid volume which can be received in the container 500 is typically up to 3 mL.

The mixing chamber 124 further comprises magnetic particles 506. The particles 506 may already be arranged in the mixing chamber 124 before the onset of centrifugation, for example before insertion of the cartridge 100 in the centrifuge. Alternatively, the particles 506 can be held in one or more chambers 120, 122 of the second drum 106 and introduced under controlled rotational speed at a specific moment. Reference is made in this regard to the above, where the function of the displacement device 300 is described. Furthermore, the particles 506 can be held in one or more chambers 120, 122, together with one of the liquids 502, 504, and can be later introduced together (that is to say the liquid 502 with the particles 506 for example) into the mixing chamber 124 by means of the displacement device 300. The particles 506 can still be fed from the chamber 120 for example, either before or after a blood sample has been introduced into the mixing chamber 124 from the chamber 122.

The particles 506 preferably have a permanently magnetic material, for example iron. The particles 506 further preferably have a density which is greater than that of the liquids 502, 504. The particles 506 typically have a diameter of approximately 200 μm.

The centrifuge or cartridge 100 has a means 508 for producing a magnetic force 510, which acts on a respective particle 506. The means 508 is preferably formed as a permanent magnet, coil or capacitor. In the present exemplary embodiment, the means 508 is arranged radially inwardly in relation to the mixing chamber 124 and the cartridge 100. An arrangement of the means 508 radially outwardly is also possible.

The produced magnetic force 510 preferably varies over time. For example, this can occur suddenly if the means 508 produces a magnetic field which varies over time. In addition, the means 508 is formed as a coil for example, to which current is supplied suitably by means of a control device. In this case, the coil 508 can be a stationary element of the centrifuge. Alternatively, the coil 508 can be moved, that is to say for example integrated into the rotor of the centrifuge, into a specific rotor holder, into the cartridge 100, into the first drum 108 or into the container 500, and in particular can be supplied with current wirelessly. Furthermore, the means 508 can be designed to produce a magnetic field which remains constant over time, wherein the mixing chamber 124, including the particles 506, is moved relative to said magnetic field. To this end, the means 508 is formed as a permanent magnet for example. In this case, the means 508 always deflects the particles 506 when the cartridge 100 passes the means 508 over its circular path.

According to the exemplary embodiment in accordance with FIG. 5, the means 508 is formed as a coil. The magnetic force produced by the coil 508 by means of the control device acts against the centrifugal force 142 and exceeds said centrifugal force periodically for example. As a result of this in particular and also due to the fact that the particles 506 have a greater density than the liquids 502, 504, the particles 506 move to and fro along the longitudinal axis 104 of the cartridge 100 into the liquids 502, 504, which also leads to a movement of the particles 506 in a direction transverse to the longitudinal axis 104 due to the currents which prevail.

Alternatively, the movement of the particles 508 can also be controlled exclusively by means of the coil 508. That is to say, the coil 508 produces a magnetic force 510, which acts alternately against the centrifugal force 142 and in the direction of the centrifugal force 142. In this case, the density of the particles 506 and also the strength of the centrifugal force 142 do not play any part, or only play an insignificant part.

In addition to the mixing of the liquids 502, 504, the described method can also be used to accelerate biochemical binding processes. At least one liquid 502, which contains at least one type of biochemical probe (for example DNA, antigens, antibodies, proteins, cells, gene sequences, amino acids) is then located in the mixing chamber 124. A type of receptor molecule (for example DNA, antigens, antibodies, proteins, cells, gene sequences, amino acids) is located on the particles 506 and binds precisely to this type of biochemical probe. Due to the movement of the particles 506 through the liquid 502, the particles 506 are charged in an accelerated manner by the biochemical probes.

In a further embodiment, the mixing of liquids 502, 504 and the binding of biochemical probes to the surface of a respective particle 506 take place in a single process step.

Figure 6A:
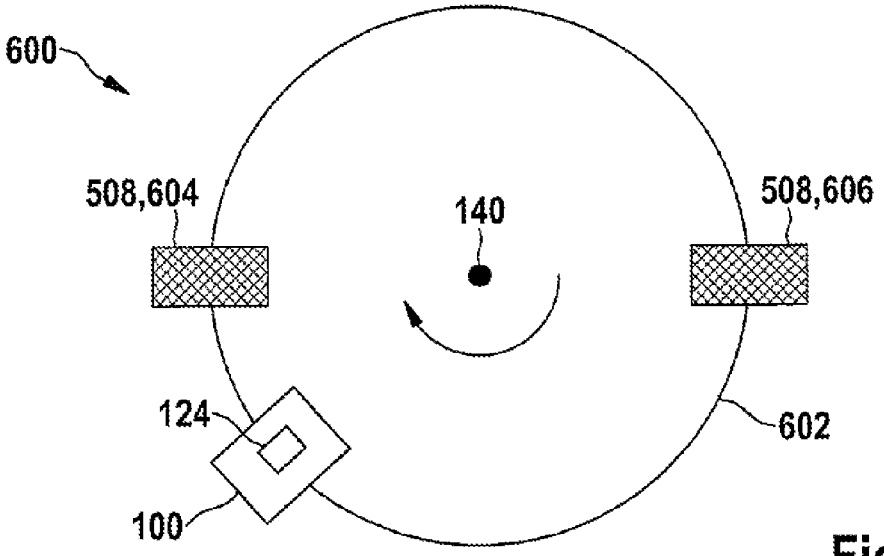
FIGS. 6A and 6B show, respectively, a schematic plan view of a centrifuge in accordance with an exemplary embodiment of the present disclosure and a schematic side view of the centrifuge.
Figure 6B:
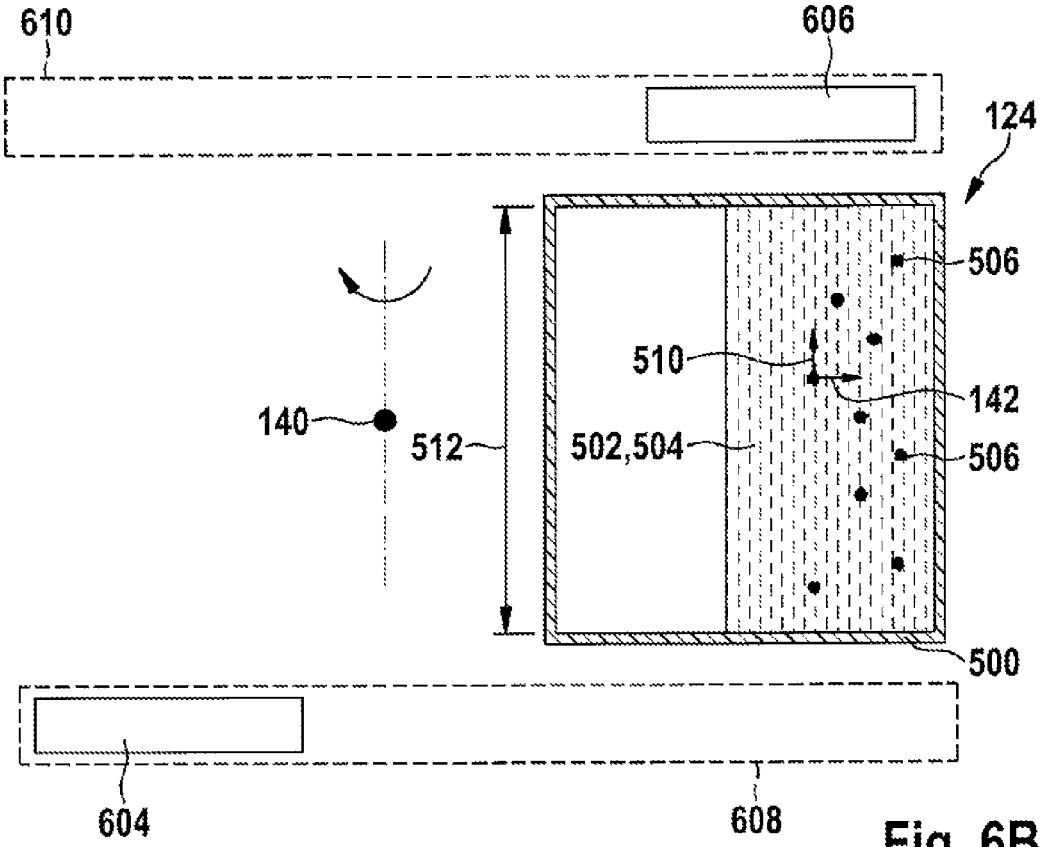

FIG. 6A shows a schematic plan view of a centrifuge 600 according to an exemplary embodiment of the present disclosure. FIG. 6B shows a schematic side view of the centrifuge 600. Apart from the mixing chamber 124, the cartridge 100 is not illustrated in FIG. 6B for the sake of simplicity.

The cartridge 100, including the chamber 124, is moved in a holder (not illustrated) of the centrifuge 600 over a circular path 602 about the center of rotation 140. The centrifuge 600 has two permanent magnets 508, which are each stationary and are denoted by reference signs 604 and 606 for the sake of improved distinction. As can be seen in FIG. 6B, one permanent magnet 604 is arranged below the circular path 602, and the other permanent magnet 606 is arranged above the circular path 602. To this end, the lower permanent magnet 604 is integrated into a base 608 of the centrifuge 600, and the upper permanent magnet 606 is integrated into a cover 610 of the centrifuge 600 for example. In addition, the permanent magnets 604, 606 are offset from one another along the circular path 602 in the plan view from FIG. 6A. For example, the permanent magnets 604, 606 are mutually opposed in relation to the center of rotation 140.

If the cartridge 100, including the chamber 124, is then moved over the circular path 602 past the permanent magnets 604, 606, said permanent magnets each produce a magnetic force 510, which acts on a respective particle 506, not parallel, but in particular substantially perpendicular, to the centrifugal force 142. Since the permanent magnets 604, 606 are arranged on different sides of the circular path 602, the magnetic force 510 when the permanent magnets 604, 606 are passed acts once downwardly and once upwardly, which leads to a corresponding movement to and fro of the particles 506 downwardly and upwardly, perpendicular to the centrifugal force 142. In particular, the particles 506 move over the entire inner width 512 of the container.

For example, coils could also be used instead of the permanent magnets 604, 606, said coils being supplied with current and thus producing the magnetic force 508 when they are passed by the cartridge 100 and mixing chamber 124.

Figure 7A:
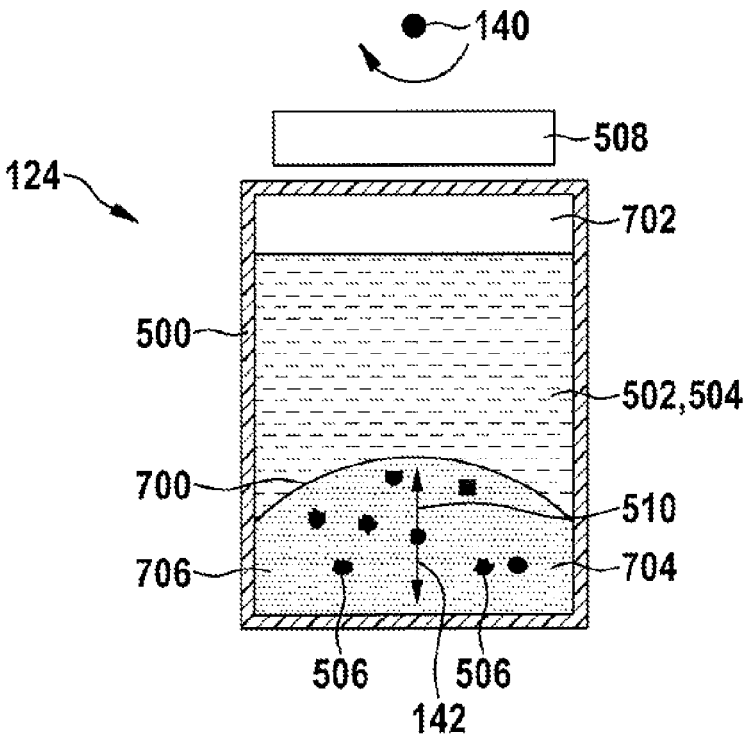
FIGS. 7A and 7B show a variant of the exemplary embodiment of FIG. 5, wherein two different states are shown.
Figure 7B:
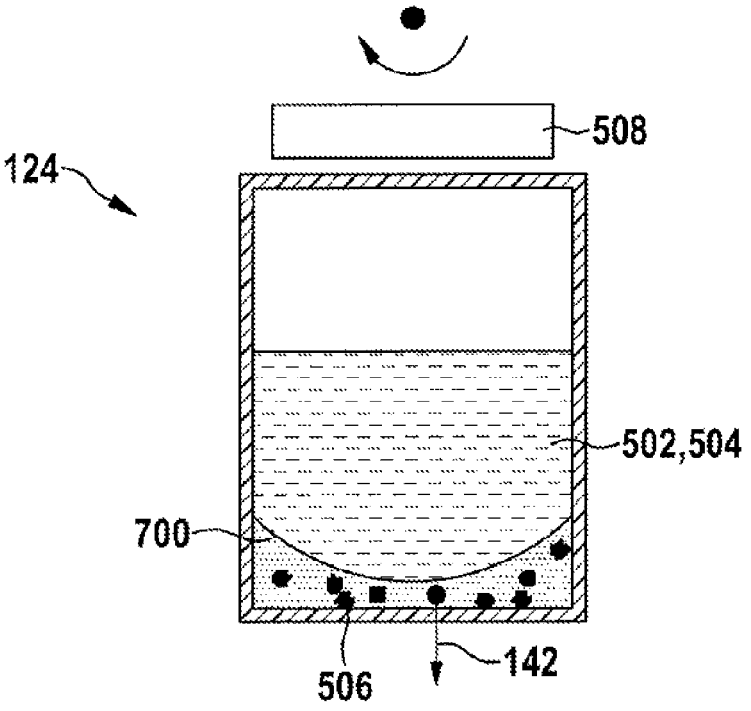

FIGS. 7A and 7B show a variant of the exemplary embodiment according to FIG. 5, wherein two different states are shown.

The mixing chamber 124 according to FIGS. 7A and 7B comprises a flexible, in particular resilient, membrane 700, for example made of silicone, thermoplastic elastomer or polyamide. The membrane 700 divides the container 500 into a first volume 702 and a second volume 704. The liquids 502, 504 are received in the first volume 702. The second volume 704 contains the particles 506 and, where necessary, a gas 706. Alternatively, the particles 506 can also be provided in the form of a "ferrofluid".

The magnetic force 510, which changes over time, acts in conjunction with the centrifugal force 142, such that the particles 506 move to and fro in relation to the center of rotation 140, that is to say along the longitudinal axis 104, and deform the membrane 700. The membrane 700 thus acts on the liquids 502, 504 and thus mixes them. FIG. 7A shows a first state, in which the magnetic force 510 acts on a respective particle 506, and FIG. 7B shows a second state, in which no magnetic force 510 and merely the centrifugal force 142, acts on a respective particle 506. The first and second liquid 502, 504, which deform the membrane 700, are in the second state.

In all of the above exemplary embodiments, mixing can advantageously be carried out independently of the rotational speed of the rotor of the centrifuge. For example, mixing can be carried out at constant, increasing or decreasing rotational speed. According to an exemplary embodiment, the rotational speed of the centrifuge can be selected in such a way that the corresponding centrifugal force 142 exceeds a predetermined threshold value, and therefore the displacement device 300 rotates the drum 108 with the mixing chamber 124, thus connecting the chamber 124 conductively to a further chamber 120, 122, 132, 136. At the same time, the particles 506 already move in the container 500, and the components 502, 504 can thus be mixed together whilst one or both components 502, 504 flow into the mixing chamber 124 or flow out therefrom.

The exemplary embodiments described in this case are particularly preferably combined with one another. In particular, this is possible for the exemplary embodiments according to FIG. 5 and FIGS. 6A and 6B as well as FIGS. 7A and 7B and FIGS. 6A and 6B. The particles 506 are therefore moved to and fro in the longitudinal direction 104 and perpendicular thereto upon each full revolution of the cartridge 100.

Furthermore, the mixing chamber 124 may have an obstruction structure (not illustrated), for example a screen or a lattice structure, which is designed to move through the liquids 502, 504 or to be passed through by the liquids 502, 504 (the latter in the case of a stationary obstruction structure) under the effect of a centrifugal force (that is to say when the rotational speed of the centrifuge exceeds a predetermined threshold value), so as to mix said liquids.

The housing 102 and the drums 106, 108, 110 can be produced from the same or from different polymers. The one or more polymer(s) is/are thermoplastics, elastomers, or thermoplastic elastomers in particular. Examples include cyclic olefin polymer (COP), cyclic olefin copolymer (COC), polycarbonates (PCs), polyamides (PAs), polyurethanes (PUs), polypropylene (PP), polyethylene terephthalates (PETs) and poly(methyl methacrylates) (PMMAs).

One or both drums 106, 110 can be formed in one piece with the housing 102.

Although the disclosure has been described herein on the basis of preferred exemplary embodiments, it is in no way limited thereto, but can be modified in many ways. In particular, it is noted that the embodiments and exemplary embodiments described herein for the cartridge according to the disclosure are accordingly applicable to the centrifuge according to the disclosure and to the method according to the disclosure for mixing a first and a second component, and vice versa. It is also noted that "a" and "an" do not exclude a plurality in the present case.

What is claimed is:

1. A cartridge configured for insertion in a centrifuge, comprising:

a first drum defining a first chamber therein, the first chamber comprising a mixing chamber, the mixing chamber including electromagnetic particles; and a second drum defining a second chamber therein; and a displacement device configured to rotate the first drum about a center axis such that, when a centrifugal force exceeds a predetermined threshold value, the first drum is rotated from a first position at which the first chamber and the second chamber are fluidly disconnected from each other to a second position at which the first chamber and the second chamber are fluidly connected to each other, wherein the electromagnetic particles are movable by an electromagnetic force to mix components in the mixing chamber.

2. The cartridge according to claim 1, wherein the displacement device includes a first slanted edge, which cooperates with a second slanted edge of the first drum to bring the first drum out of the first position, in which the first drum engages with a positive fit with a housing of the cartridge in the direction of rotation about the center axis, and into the second position along the center axis, against the action of a restoring mechanism, the positive fit being annulled in the second position and the first drum rotating about the center axis.

3. The cartridge according to claim 1, wherein the second drum is arranged upstream from the first drum, based on the center axis.

4. The cartridge according to claim 1, further comprising a third drum which has a third chamber.

5. The cartridge according to claim 1, further comprising a force mechanism configured to produce the electromagnetic force.

6. The cartridge according to claim 5, wherein the force mechanism is integrated into one or more of a housing of the cartridge, the first drum, the second drum, and a third drum.

7. The cartridge according to claim 1, wherein the mixing chamber has a flexible membrane, which divides the mixing chamber into a first volume and a second volume, wherein the components are received in the first volume and the electromagnetic particles are received in the second volume, and wherein the membrane is deformable by the electromagnetic particles under the effect of the electromagnetic force to mix the components within the first volume.

8. The cartridge according to claim 1, wherein the components mixed in the mixing chamber include a first component formed as a biochemical probe and a second component formed as a receptor molecule that binds the biochemical probe, the electromagnetic particles being configured to carry the first component or second component.

9. A centrifuge, comprising:

a cartridge configured to be inserted into the centrifuge, the cartridge including:

a first drum defining a first chamber therein, the first chamber comprising a mixing chamber, the mixing chamber including electromagnetic particles; and a second drum defining a second chamber therein; and a displacement device configured to rotate the first drum about a center axis such that, when a centrifugal force exceeds a predetermined threshold value, the first drum is rotated from a first position at which the first chamber and the second chamber are fluidly disconnected from each other to a second position at which the first chamber and the second chamber are fluidly connected to each other, wherein the electromagnetic particles are movable by an electromagnetic force to mix components in the mixing chamber, and at least one force mechanism configured to produce the electromagnetic force.

10. The centrifuge according to claim 9, wherein the electromagnetic force produced by the force mechanism is configured to act in one or more of a direction against a centrifugal force, a direction perpendicular to the centrifugal force, and a direction that is the same as the centrifugal force.

11. The centrifuge according to claim 9, wherein the force mechanism includes at least one first force mechanism and at least one second force mechanism, the first force mechanism being arranged on a first side of a circular path along which the cartridge is movable during centrifugation, and the second force mechanism being arranged on a second side of the circular path, and the first and second force mechanisms being distanced from one another along the circular path.

12. The centrifuge according to claim 9, wherein the at least one force mechanism is integrated into a housing of the centrifuge.

13. The centrifuge according to claim 12, wherein the at least one force mechanism is integrated into one or more of a base and a cover of the housing.

* * * * *